US006050440A

United States Patent [19]

McEldowney

[11] Patent Number: 6,050,440

[45] **Date of Patent: *Apr. 18, 2000**

[54] EASY OPEN CONTAINER END, METHOD OF MANUFACTURE, AND TOOLING

[75] Inventor: Carl McEldowney, Russia, Ohio

[73] Assignee: Aluminum Company of America, Pittsburgh, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/603,820

[22] Filed: Feb. 20, 1996

Related U.S. Application Data

[63] Continuation-in-part of application No. 29/048,638, Jan. 5, 1996.

[51] Int. Cl.[7] ..... B65D 17/34

[52] U.S. Cl. ..... 220/269; 220/271; 220/608; 220/906

[58] Field of Search ..... 220/269, 906, 220/254, 266, 268, 270, 271, 265, 608

[56] References Cited

U.S. PATENT DOCUMENTS

| | | | |
|---|---|---|---|
| Re. 31,702 | 10/1984 | Brown . | |
| D. 337,521 | 7/1993 | McNulty . | |
| D. 338,156 | 8/1993 | Cook . | |
| D. 365,988 | 1/1996 | Clark, III . | |
| 3,534,883 | 10/1970 | Khoury . | |
| 3,929,252 | 12/1975 | La Croce . | |
| 3,977,561 | 8/1976 | Strobe et al. | 220/269 X |
| 4,015,744 | 4/1977 | Brown . | |
| 4,024,981 | 5/1977 | Brown . | |
| 4,061,243 | 12/1977 | Khoury . | |
| 4,148,410 | 4/1979 | Brown | 220/269 |
| 4,184,607 | 1/1980 | Potts . | |
| 4,205,760 | 6/1980 | Hasegawa . | |
| 4,210,257 | 7/1980 | Radtke . | |
| 4,211,335 | 7/1980 | Langseder . | |
| 4,219,127 | 8/1980 | Bielicki | 220/269 |
| 4,276,993 | 7/1981 | Hasegawa . | |
| 4,361,251 | 11/1982 | Langseder et al. . | |
| 4,363,419 | 12/1982 | Walz, Sr. . | |
| 4,387,827 | 6/1983 | Ruemer, Jr. . | |
| 4,465,204 | 8/1984 | Kaminski et al. . | |
| 4,733,793 | 3/1988 | Moen . | |
| 4,872,597 | 10/1989 | Hanafusa . | |
| 4,930,654 | 6/1990 | Thibeault et al. . | |
| 4,930,658 | 6/1990 | McEldowney | 220/269 |
| 4,951,835 | 8/1990 | DeMars et al. | 220/269 |
| 5,011,037 | 4/1991 | Moen et al. | 220/269 X |
| 5,129,541 | 7/1992 | Voigt et al. | 220/269 |
| 5,131,555 | 7/1992 | DeMars et al. | 220/269 |
| 5,224,618 | 7/1993 | Garbiso | 220/269 |
| 5,248,053 | 9/1993 | Lundgren | 220/269 |
| 5,375,729 | 12/1994 | Schubert | 220/269 X |
| 5,405,039 | 4/1995 | Komura | 220/269 |
| 5,456,378 | 10/1995 | DeMars | 220/269 |

*Primary Examiner*—Stephen Castellano
*Assistant Examiner*—Niki M. Eloshway
*Attorney, Agent, or Firm*—Thomas R. Trempus

[57] ABSTRACT

An easy open can end has an improved structure for facilitating the opening operation of the tear panel, a method of further forming a can end to have the improved structure, and tooling for accomplishing the method. The further formation of the can end is particularly useful in easy-open can ends having enlarged tear panels.

12 Claims, 7 Drawing Sheets

EASY OPEN CONTAINER END, METHOD OF MANUFACTURE, AND TOOLING

CROSS-REFERENCE TO RELATED APPLICATION

This application is a continuation-in-part application of copending U.S. patent application Ser. No. 29/048,638 entitled, "Easy Open Container End", and filed on Jan. 5, 1996.

BACKGROUND OF THE INVENTION

1. Field of the Invention

The present invention relates to easy-open ends for product containers, particularly, beverage and beer cans. In particular, the present invention provides an improved method for forming easy-open ends, improved tooling, and an improved can end.

2. Prior Art

Many metallic cans for holding beverages or other products are provided with easy-open can ends, wherein a pull tab attached to a tear strip that is defined by a score line in the can end may be pulled to provide an opening in the can end for dispensing the can's contents. For ecological and safety reasons, many regions require that the tear strip and attached pull tab be retained to the can end after opening. In order to meet these requirements, various designs have been suggested by the prior art for ensuring that the tear strip and pull tab do not become separated from the can end. Generally, the pull tab is retained to the can end by means of a rivet. Methods of rivet development utilizing the prior art can be found in U.S. Pat. Nos. 4,465,204 and 4,530,631 both to Kaminski et al., and assigned to the assignee of the instant invention. These patents are incorporated herein by reference as if fully set forth.

In the manufacture of an easy-open can end, a can end shell is first formed from a metal sheet product, preferably an aluminum sheet product. The can end shell is then conveyed to a conversion press. In the typical operation of a conversion press, a can end shell is introduced between an upper tool member and a lower tool member which are in the open, spaced apart position. A press ram advances the upper tool member toward the lower tool member in order to perform any of a variety of tooling operations such as rivet forming, paneling, scoring, embossing, tab securing, and final staking. After performing a tooling operation, the press ram retracts until the upper tool member and lower tool member are once again in the open, spaced apart position. The partially converted shell is transported to the next successive tooling operation until an easy-open can end is completely formed and discharged from the press. As one shell leaves a given tooling operation, another shell is introduced to the vacated operation, thus continuously repeating the entire easy-open can end manufacturing process.

The can end manufacturing industry is continuously striving to reduce costs by developing an increasingly lightweighted can end through both reduced diameter and reduced metal gauge in order to effect enhanced cost savings through the use of less metal in each packaged product. It has been conventional practice to maintain the metal gauge of the can end to a gauge of approximately 0.0108 to 0.0116 inch. The beer and beverage industry believe that is advantageous to provide an enlarged tear strip area relative to the overall size of the can end. This enlarged tear strip is particularly useful, for example, in a typical 204 diameter can end that is most commonly used on beer cans of the type usually associated with a "six pack". The enlarged tear strip provides a larger opening through which the contents of the can may be rapidly dispensed. Because the enlarged openings can be more than thirty percent larger than conventional openings, the conventional conversion process by which a can end shell is converted into an easy open end is not satisfactory. In other words, enlarging the tear strip is not a matter of simply scaling up the dimensions of the conventional tear strip. Challenges exist in preventing "blow off" of the tear panel during opening and maintaining the smooth operation of the pull tab and resulting tear strip displacement.

It is an object of this invention to provide an improved converted can end with an enlarged opening through which the contents thereof are dispensed.

It is another object of the present invention to provide a method of further forming a can end so as to facilitate the rotation of the pull tab and operation of the easy open feature.

It is another object of this invention to provide a converted can end and a method for manufacturing the same.

It is still another object of this invention to provide the tooling stations for the formation of an improved converted can end.

SUMMARY OF THE INVENTION

The invention provides an improved stay-on-tab style, easy open can end for a container. The easy open end includes a tear panel defined by a score line surrounding a portion of the periphery of the tear panel. The score line defines a region where the tear panel is separated from the remainder of the end to form an opening through the end. An integral rivet attaches a tab to the end adjacent the score line. The score line includes a vent region adjacent the rivet constructed and arranged to open initially at the rivet construction in response to the lifting of the rivet by the tab. A bead is formed in the end proximate the rivet on the opposite side of the rivet with respect to the score line. The bead partially circumscribes the rivet, thus stiffening the end proximate the rivet so as to facilitate the lifting of the rivet as the tab is rotated upwardly from the end.

The bead defines a concavity in the end proximate the rivet on the opposite side of the rivet with respect to the score line. The bead partially circumscribes the rivet and concentrates and propagates downward forces created by the lifting of the rivet into the vent region adjacent the score line. In an alternative embodiment, a further portion of the bead defines a generally linear concavity extending laterally across a portion of said end. The linear concavity is preferably integral with the aforedescribed bead so that a first portion partially circumscribes the rivet and at least a second portion extends laterally relative to the rivet, thus stiffening the end proximate the rivet so as to facilitate the lifting of the rivet as the tab is rotated upwardly from the end.

The invention also provides tooling for use in the conversion of a can end shell into an easy open can end incorporating the bead or concavity as described above. The tooling can be located in the upper or lower tooling of a conversion station. Preferably, the station in which the instant tooling is located is after the rivet formation station and prior to the tab staking station.

DESCRIPTION OF THE DRAWINGS

The above as well as other features and advantages of the present invention can be appreciated through consideration of detailed description of the invention in conjunction with the several drawings in which.

DETAILED DESCRIPTION OF THE INVENTION

Figure 1:
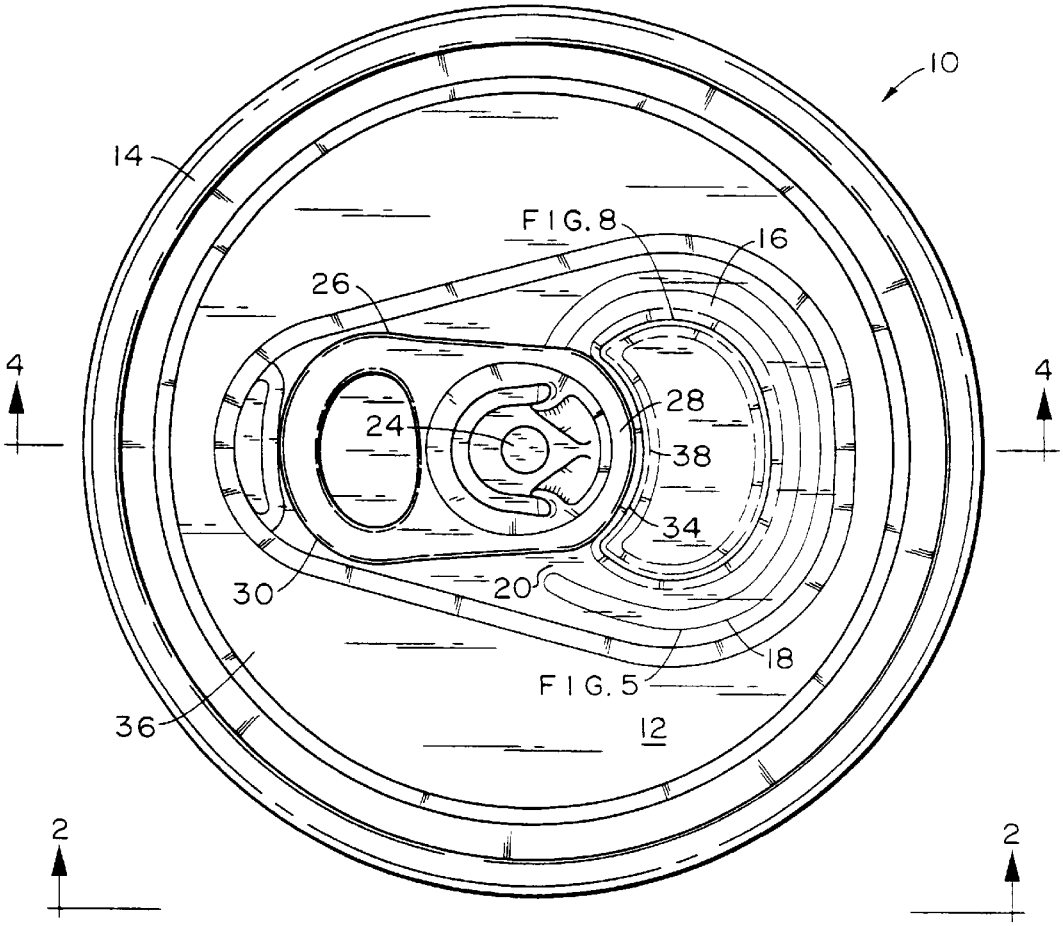
FIG. 1 is a top plan view of the improved easy-open can end of the present invention.
Figure 2:
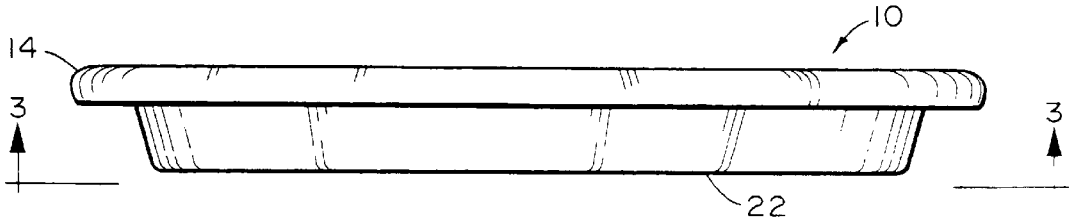
FIG. 2 is a side elevation view of the easy-open can end of FIG. 1.
Figure 3:
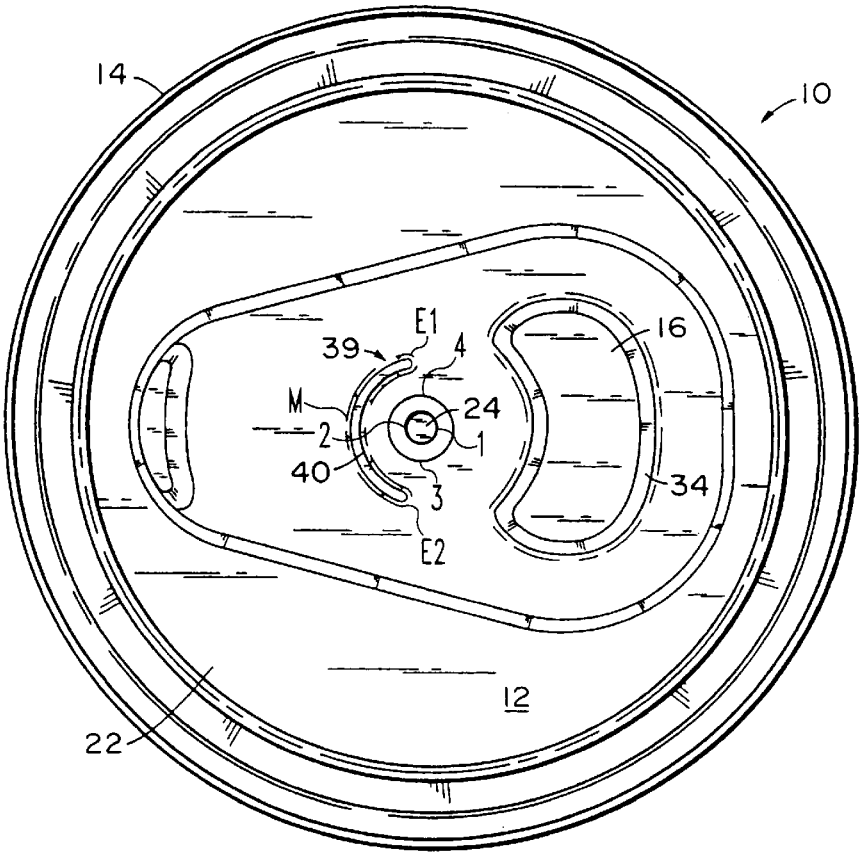
FIG. 3 is a bottom plan view of the easy-open can end of FIGS. 1 and 2.
Figure 4:
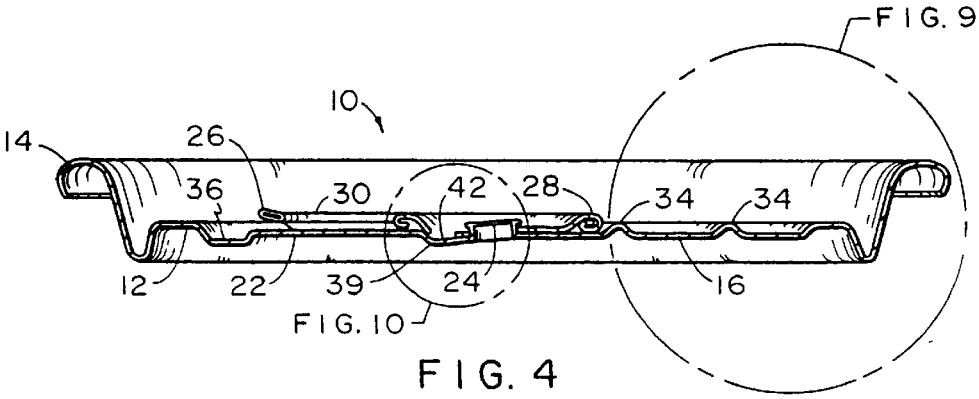
FIG. 4 is a section through the easy-open can end of FIG. 1 along lines 4—4 thereof.
Figure 5:
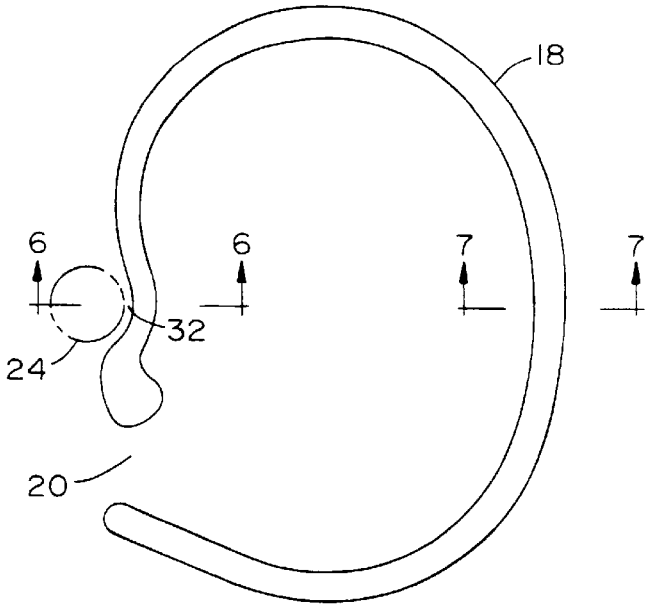
FIG. 5 is a top plan view of the score line of the tear panel of the easy-open can end with the rivet shown in phantom.
Figure 6:
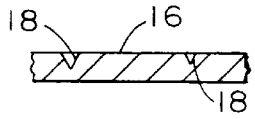
FIG. 6 is a sectional view of the score line of the tear panel of the easy-open end along lines 6—6 of FIG. 5.
Figure 8:
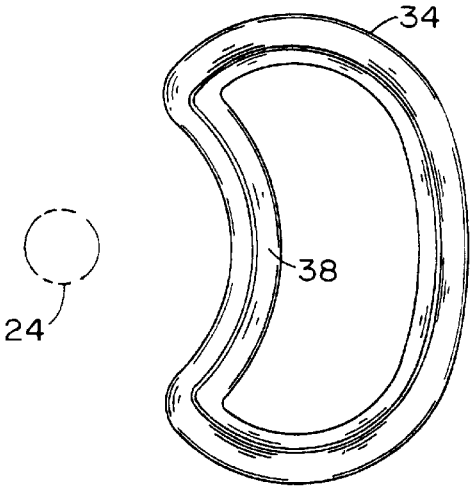
FIG. 8 is a top plan view of the tear panel bead of the easy-open end with the rivet shown in phantom.
Figure 7:
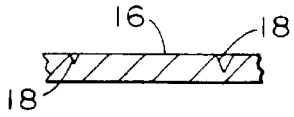
FIG. 7 is a sectional view of the score line of the tear panel of the easy-open end along lines 7—7 of FIG. 5.
Figure 9:
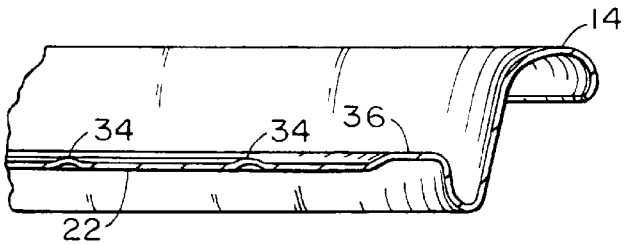
FIG. 9 is a section through a partial can end tear panel illustrating the beading structure generally along lines 9—9 of FIGS. 4 and 8.

The converted can end of the present invention is designated by reference character 10 in FIGS. 1 through 4. Can end 10 has an end panel 12 of generally circular shape which includes a circumferentially extending raised edge 14 for attaching the can end 10 to a suitable cylindrical beverage can (not shown) or the like. In general, the can end 10 will be manufactured of a relatively ductile metal such as, for example, aluminum, but it may be made from other acceptable materials as required, such as for example, steel.

A retained tear panel or tear strip 16 extends across can end 10 from a position spaced inwardly of raised edge 14 to approximately the center of can end 10. Tear strip 16 is defined by a generally U-shaped score line 18 with open end 20 of the U positioned toward the center of can end 10. A score line 18 is interrupted so that tear strip 16 will be captively retained on the underside or product side, 22 of can end 10 when torn open.

An integral rivet 24 is positioned adjacent open end 20 of U-shaped score line 18 and on the opposite side of the score line from the tear strip 16, and a graspable ring-like pull tab 26 which may be of any desired size and configuration is secured to can end 10 by means of rivet 24. When the easy open end 10 is opened to access the contents the pull tab 26 is lifted by the finger portion 30. Lifting the pull tab upwardly from the panel 12 causes the rivet 24 to rupture a vent region 32 (FIG. 11) proximate the rivet 24. Subsequent to the venting of any built up pressure within the container, the lifting of the pull tab 26 continues so that the nose portion 28 of the pull tab 26 initiates the tear along score line 18. The tear strip 16 then is torn open as is well known in the art.

As generally described above, the can end 10 includes a tear strip 16 defined by the score line 18. This tear strip 16 is approximately 30% larger than a conventional tear strip. The enlarged opening resulting from the use of an enlarged tear strip preferably defines an opening extending at least 3 mm across at its widest point. The enlarged opening allows the contents of the container to be dispensed more quickly. The tear strip portion 16 includes a bead 34 that is preferably convex relative to the consumer side 36 of the can end 10. The portion of the tab bead 34 nearest the rivet 24 is disposed in a concave or crescent like configuration 38 with respect to the rivet 24. Preferably, this concave feature 38 is configured so as to cooperate with the nose 28 of the pull tab 26. By cooperate it is meant that the tab bead 34 does not interfere with the nose 28 of the tab as the tab is lifted upwardly from the panel 12 by means of the finger portion 30 thereof. As the tab 26 is rotated upwardly by the finger pull portion thereof, the rivet 24 onto which the tab 26 is staked is bent forwardly toward the vent region 32. The movement of the rivet 24 toward the vent region 32 causes an initial rupture of the score line 18 proximate the rivet 24. As the pull tab 26 is actuated, it functions like a lever and causes the pivoting of the rivet 24 toward the vent region. This fulcrum-like motion of the pull tab 26 creates strain in the end panel portion 12 near the rivet 24 on the side thereof opposite the vent region 32. In order to address the lifting moment of the panel aft of the rivet 24, a bead 39 is formed near the rivet 24. The bead or concavity 39 (FIG. 3) is disposed so as to concentrate and propagate the forces resulting from the fulcrum-like action of the pull tab into first the vent region 32 and then subsequently the complete score line 18 in order to at least partially liberate the tear tab from the panel and access the contents of the container.

In one embodiment of the invention as shown most clearly in FIGS. 3, 4, 10, and 11, the bead 39 has a crescent like shape generally indicated by reference character 40. A generally concave side 42 of the bead 39 extends at least partially around the rivet 24. Preferably, as viewed from the product side 22 of the can end 10, the bead 38 is concave. Accordingly, and conversely, when the bead 39 is viewed from the public side 36 of the end 10 the bead is convex. In other words, the end panel is further formed so as to define a concavity in the end proximate the rivet on the opposite side of the rivet with respect to the score line. The concavity partially circumscribes the rivet. In order to associate the concavity with respect to the rivet, the rivet 24 can be understood to have a first side, generally indicated by the reference character 1, proximate the score line, a second side 2 opposite the first side, and third 3 and fourth 4 sides extending between the first and second sides. The bead or concavity 39 has a mid-portion "M" and opposed end-portions "E1" and "E2" extending from the mid-portion, defining the crescent like shape generally indicated by the reference character 40 in FIG. 3. The concavity mid-portion "M" is disposed proximate the second side 2 of the rivet 24.

Figure 10:
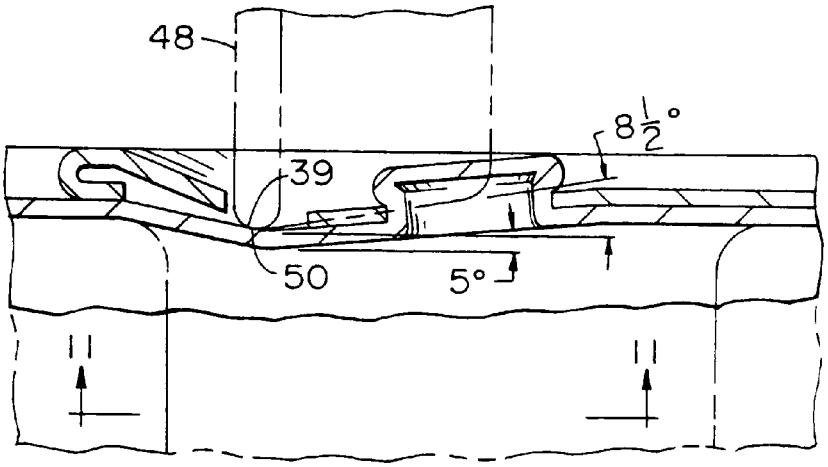
FIG. 10 is a sectional view through a portion of the can end proximate the rivet showing in phantom the tooling by which the bead is formed.

The opposed end-portions E1 and E2 extend from the mid-portion of the concavity along both the third 3 and fourth 4 sides of the rivet 24. The disposition of the bead 39 with respect to the rivet 24 tends to eliminate or at least substantially reduce, any loose or excess metal in the panel 10 aft of the rivet 24 and to strengthen the portion of the panel 10 proximate the rivet 24. It should be appreciated that while the bead is described as being convex as viewed from the public side, the tooling can be configured so that the bead is concave as viewed from the public side. It is a matter of locating the punch 48 in either the upper of lower tooling. For example, FIG. 10 shows the punch in the upper tooling. With this configuration, the bead is concave as viewed from the public side.

Figure 12:
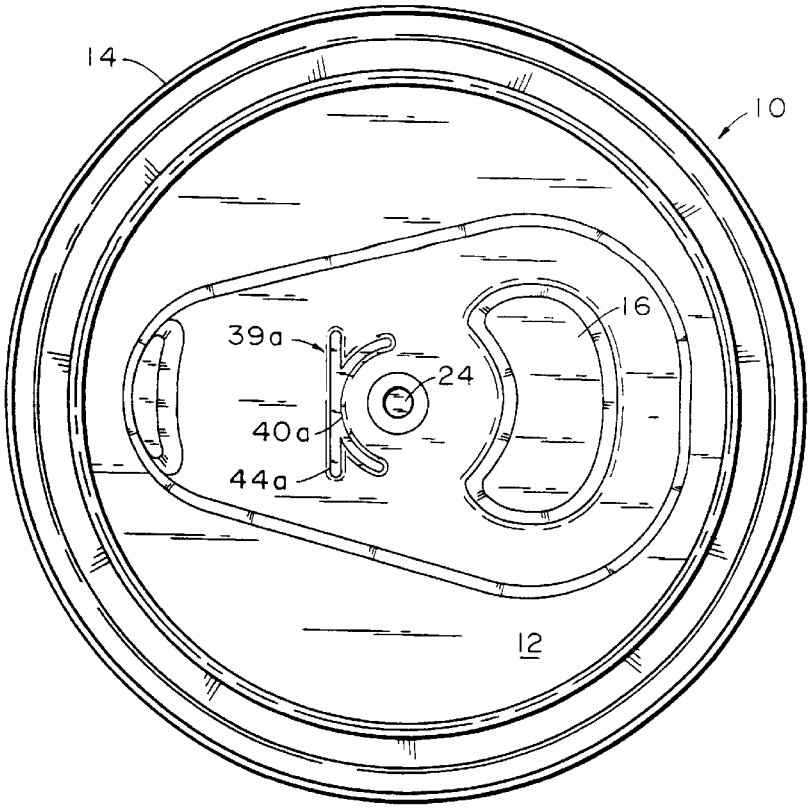
FIG. 12 a bottom plan view of an alternative embodiment of the strengthening bead.
Figure 13C:
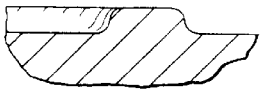
FIG. 13*c* is an enlarged portion of the alternative tooling taken from FIG. 13*b;*
Figure 13A:
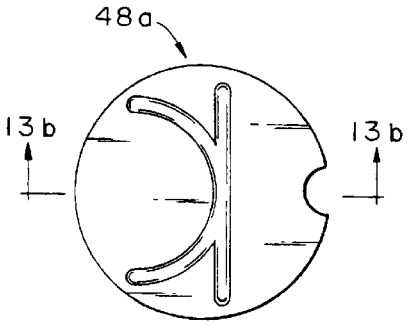
FIG. 13*a* is a plan view of the metal working face of the tooling of the alternate embodiment shown in FIG. 12, according to this invention.
Figure 13B:
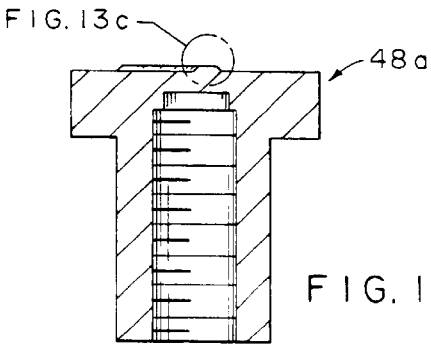
FIG. 13*b*is a sectional elevational view of the alternative tooling taken on Line 13*b*—13*b* of FIG. 13*a*.

An alternative embodiment of the bead 39 is shown in FIG. 12 and identified by the reference character 39*a*. Alternative bead configuration 39*a* shares the general configuration of the vent bead 39 as described above and includes further features. The further features provide extended beading 44*a* that defines a generally linear portion in tangential relationship to the crescent like shape 40*a*. The overall beading configuration 39*a* tends to strengthen the metal not only proximate the rivet 24 but also that portion of the end panel more distal therefrom. It is important to appreciate that in forming the bead 39 or 39*a*, if too large a portion of the end panel is beaded, undesirable stress can be placed on the score lines 18. It also should be generally appreciated that the bead designed 39 and 39*a* are representative of bead configurations that can be disposed in a manner consistent with the teachings of this invention. The face of tooling means for the bead configuration of FIG. 12 is shown in FIG. 13*a* through 13*c*.

Figure 14:
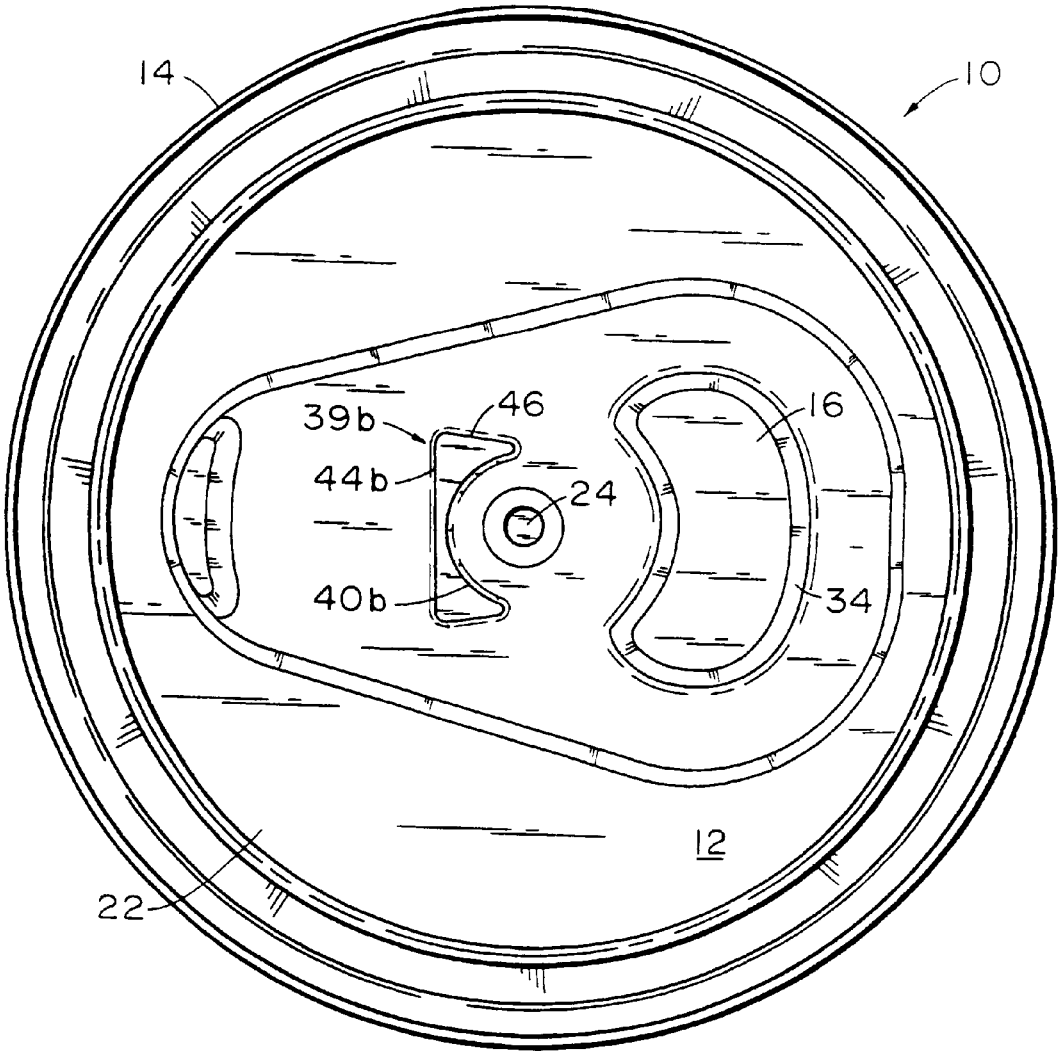
FIG. 14 is a top plan view of another alternative embodiment of the strengthening bead.

A further embodiment of this invention is shown in FIG. 14. Here, the bead or concavity 39*b* is formed to include the portion 46 of the panel extending generally between the crescent like shape 40*b* and the linear portion 44*b*.

Figure 15:
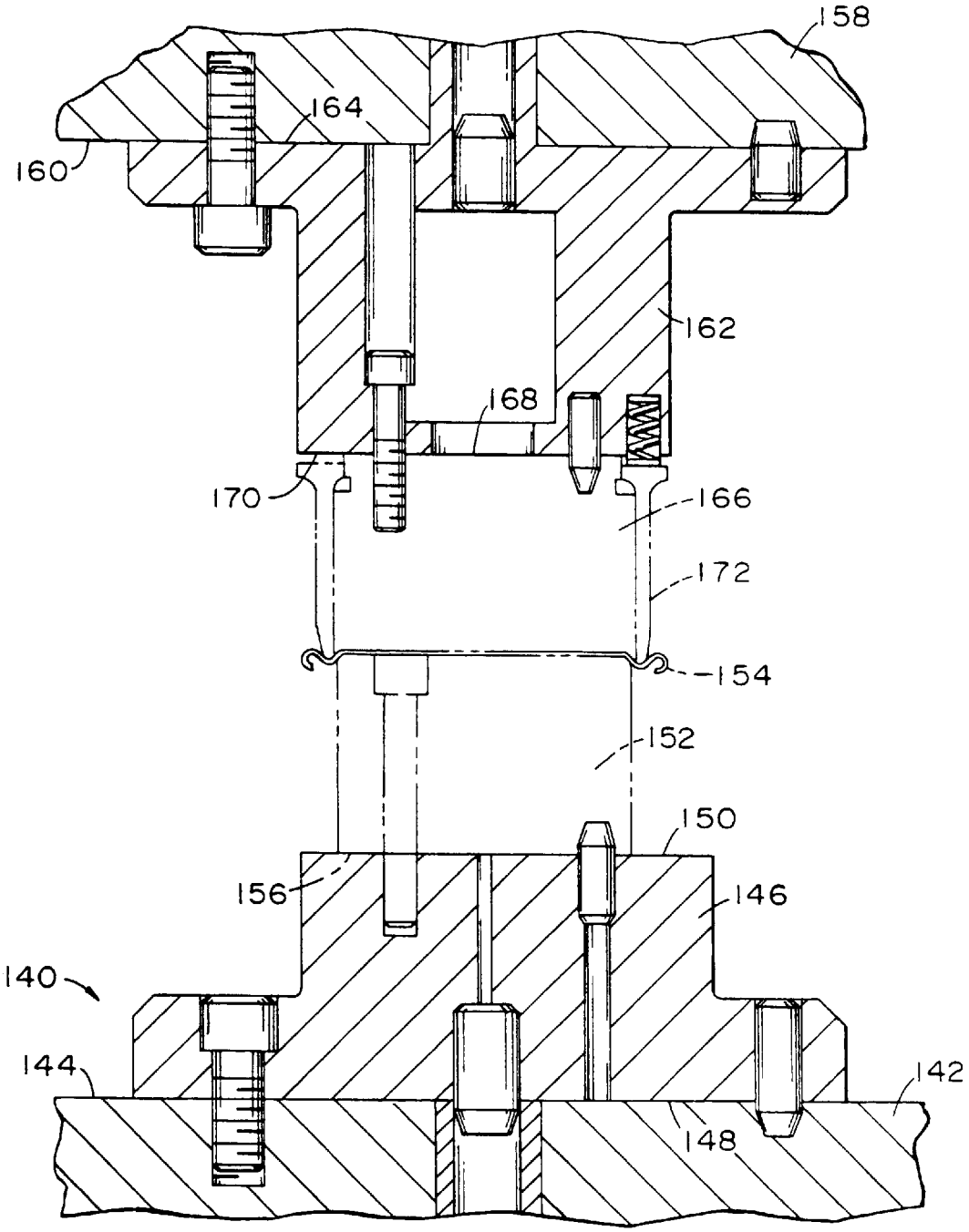
FIG. 15 is a cross sectional side view illustrating the conversion press ram, tool support means, ram, upper and lower tool members, a support base and a stationary press bed.

The manufacture of a can end shell into an easy-open can end takes place in a conversion press as shown in FIG. 15. The conversion press 140 generally include a stationary press bed 142 including a generally planar horizontal upper surface 144. The upper surface supports a tooling base 146 which has a planar bottom surface 148 and a planar upper surface 150. Positioned upon the upper surface of tooling base is a lower tooling member 152 (shown in phantom) which may take a variety of shapes depending upon the tooling operation to be performed on the can end shell 154. However, each lower tooling member 152 has a planar bottom surface 156 which mates with the upper surface 150 of the tooling base 146 to provide secure support for the lower tooling member 152.

A vertically displaceable press ram 158 overlies press bed and includes a generally planar horizontal lower surface 160. This surface 160 of the press ram 158 supports a tool support means 162 which may take a plurality of shapes depending upon the type selected for a particular tooling operation. In general, however, the tooling support means or base 162 includes an upper planar surface 164 which provides solid mating contact with the surface 160 of the press ram 158 so that the tooling support means 162 is securely fastened to the press ram. The tool support means 162 securely supports an upper tooling member (shown in phantom) 166 having an upper planar surface 168 that is in mating contact with the lower planar surface 170 of the tool support means 162. The upper tooling member 166 can be one of many shapes and sizes depending upon the particular tooling operation to be performed. Typically, a centering ring 172 locates the can end shell 154 in each tooling station. The various types of tooling operations to be performed in succession include: bubble forming in the center of the open can lid, forming the bubble into a button; scoring an opening; paneling the can end in an area surrounding the scored opening; staking the pull tab to the can end; and stamping incise lettering upon the can end for messages such as "lift up, pull back" or "dispose of properly". U.S. Pat. No. 4,610,156, which is assigned to the assignee of the instant invention, sets forth a detailed description of the various tooling stations of a conversion press. The contents of this patent are incorporated by reference as a fully set forth herein. The can end conversion process may require from six to eight stations in which differently configured tooling effects each successive stage in the conversion of a can end shell in an easy-open can end.

Figure 11:
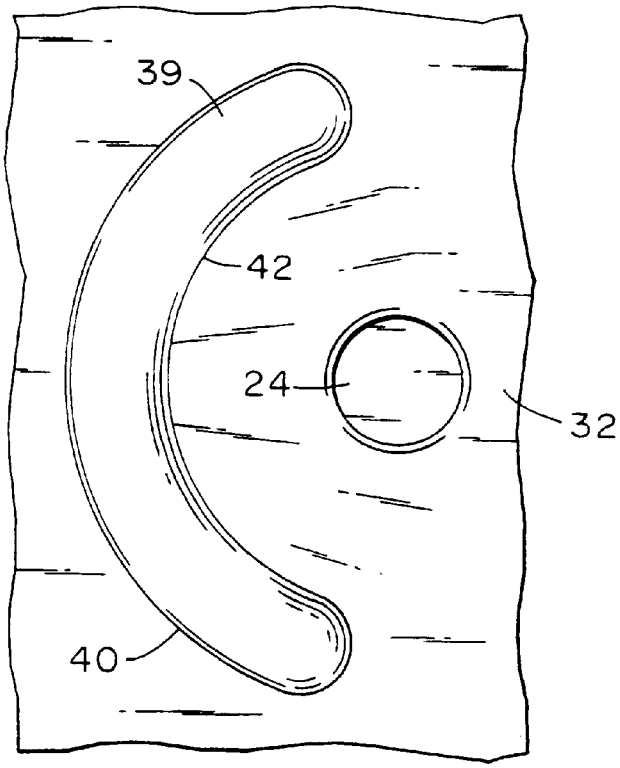
FIG. 11 is a bottom plan view of a detail of one embodiment of the strengthening bead taken along line 11—11 of FIG. 10.

The method of the instant invention calls for further forming a bead or concavity in the panel 12 aft of the rivet 24. This concavity is in the end proximate the rivet on the opposite side of the rivet with respect to the score line. The concavity at least partially circumscribes the rivet. Tooling suitable for forming the bead 39 illustrated in FIG. 11 is shown in phantom in FIG. 10. This tooling 48 is incorporated into the upper tooling member 166 as shown in FIG. 15. The tooling 48 has a working surface 50 having a radius adapted to provide the bead or concavity 39 in the panel. It is to be appreciated that while the bead 39 is defined as a concavity with respect to the public side of the can end, it can be disposed so as to be convex with respect to the public side of the end panel.

It should be appreciated that the tooling indicated at the reference character 48 may have a variety of metal working edges 50 to meet the particular bead configuration. For example, there is shown in FIG. 13, the working face 50 of tooling adapted to produce the bead shown in FIG. 12. Likewise, while tooling 48 is shown as a part of the upper tooling member 166, it is of course possible to incorporate the appropriate tooling into the lower tooling member 152 and an appropriate relief disposed in the upper tooling 166. It is preferred that the concavity be concave with respect to the product side of the can end so that the further formed metal does not depend downwardly from the panel portion of the can-end. It is typical to stack converted can ends after manufacture. By further forming the can end so that the concavity is concave with respect to the product side, the product side of a first end will be unlikely to interfere with the public side of the end upon which it is stacked.

By beading it is meant the displacement of metal. The enlarged detail of FIG. 10 shows both a cross sectioned shape of the bead and a cross section of the portion of the punch which produces the bead. This configuration is preferably added to the punch and die at the station immediately prior to that at which the tab is staked onto the rivet. Generally, it is not an object of this invention to provide the compression of metal to define the bead or form the concavity. It is fundamentally desirable through the practice of this invention to provide a further formed concavity or bead structure which takes up loose metal proximate the rivet and provides a rigidity which concentrates and propagates forces generated during the opening operation of the easy open end to the desired locations of the tear panel.

While the method herein described, and the forms of the apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. In an easy open end for a container, said end having a tear panel defined by a score line surrounding a portion of the periphery of said tear panel, said score line defining a region where said tear panel is to be separated from the remainder of the end to form an opening through said end, an operating tab having a nose at one end and a finger pull to said end adjacent said score line and on the opposite side of said score line from said tear panel, said rivet having one side proximate said score line, a second side opposite thereto, and third and fourth opposed sides extending between said first and second sides, said score line including a vent region adjacent said rivet constructed and arranged to open initially at said rivet construction in response to lifting of said rivet by said tab, the improvement comprising:

a concavity formed in said end and located proximate said rivet so as to be disposed under the attached tab proximate said tab nose portion but on the opposite side of said rivet with respect to said score line, said concavity partially circumscribing said rivet and extending from said second side of said rivet along at least a portion of both said third and fourth sides of said rivet, wherein said concavity has a mid-portion and opposed end portions, said mid-portion being proximate said second side of said rivet and wherein said opposed end-portions extend from said mid-portion along both said third and fourth sides of said rivet toward said score line, said concavity further including a linear concavity portion in tangential contact therewith, said concavity thus stiffening said end proximate said rivet in order to concentrate and propagate forces generated during the opening operation of said easy open end toward said tear panel so as to facilitate the lifting of said rivet as said tab is rotated upwardly from said end.

2. The easy open end for a container according to claim 1 wherein the end has a public side and a product side and the concavity is convex when viewed from the public side.

3. The easy open end for a container according to claim 1 wherein the end has a public side and a product side and the concavity is concave when viewed from the public side.

4. The easy open end for a container according to claim 1 wherein said end is formed from aluminum.

5. The easy open end for a container according to claim 1 wherein said end is formed from steel.

6. The easy open end for a container according to claim 1 wherein said score line defining a region where said tear panel is to be separated from the remainder of the end to form an opening through said end, defines an enlarged opening extending at least 3 mm across at its widest point.

7. In an easy open end for a container, said end having a tear panel defined by a score line surrounding a portion of the periphery of said tear panel, said score line defining a region where said tear panel is to be separated from the remainder of the end to form an opening through said end, an operating tab having a nose at one end and a finger pull portion opposite thereto, and an integral rivet attaching said tab proximate said tab nose portion to said end adjacent said score line and on the opposite side of said score line from said tear panel, said rivet having one side proximate said score line, a second side opposite thereto, and third and fourth opposed sides extending between said first and second sides, said score line including a vent region adjacent said rivet constructed and arranged to open initially at said rivet construction in response to lifting of said rivet by said tab, the improvement comprising:

a concavity formed in said end and located proximate said rivet so as to be disposed under the attached tab proximate said tab nose portion but on the opposite side of said rivet with respect to said score line, said concavity partially circumscribing said rivet and extending from said second side of said rivet along at least a portion of both said third and fourth sides of said rivet toward said score line, said concavity further including a linear concavity portion in tangential contact therewith, said concavity thus stiffening said end proximate said rivet in order to concentrate and propagate forces generated during the opening operation of said easy open end toward said tear panel so as to facilitate the lifting of said rivet as said tab is rotated upwardly from said end.

8. The easy open end for a container according to claim 7 wherein the end has a public side and a product side and the concavity is convex when viewed from the public side.

9. The easy open end for a container according to claim 7 wherein the end has a public side and a product side and the concavity is concave when viewed from the public side.

10. The easy open end for a container according to claim 7 wherein said end is formed from aluminum.

11. The easy open end for a container according to claim 7 wherein said end is formed from steel.

12. The easy open end for a container according to claim 7 wherein said score line defining a region where said tear panel is to be separated from the remainder of the end to form an opening through said end, defines an enlarged opening extending at least 3 mm across at its widest point.

* * * * *